US007699363B2

(12) United States Patent
Langfermann et al.

(10) Patent No.: US 7,699,363 B2
(45) Date of Patent: Apr. 20, 2010

(54) SLIDING DOOR FOR A MOTOR VEHICLE

(75) Inventors: Michael Langfermann, Wuppertal (DE); Markus Kothe, Velbert (DE)

(73) Assignee: Brose Schliesssysteme GmbH & Co. KG, Wuppertal (DE)

( * ) Notice: Subject to any disclaimer, the term of this patent is extended or adjusted under 35 U.S.C. 154(b) by 14 days.

(21) Appl. No.: 11/413,117

(22) Filed: Apr. 28, 2006

(65) Prior Publication Data

US 2006/0254145 A1 Nov. 16, 2006

(30) Foreign Application Priority Data

Apr. 28, 2005 (DE) ..... 20 2005 006 942 U

(51) Int. Cl.
*E05C 3/06* (2006.01)

(52) U.S. Cl. ..... 292/216; 292/201; 292/DIG. 15

(58) Field of Classification Search ..... 292/216, 292/201, DIG. 15; 74/501.5, 502.4, 502.6
See application file for complete search history.

(56) References Cited

U.S. PATENT DOCUMENTS

| | | | | |
|---|---|---|---|---|
| 3,100,667 | A * | 8/1963 | Schwenk | 49/214 |
| 3,198,564 | A * | 8/1965 | Welsh | 292/117 |
| 3,204,999 | A | 9/1965 | Schwenk | |
| 4,502,246 | A | 3/1985 | Minami | |
| 4,662,109 | A | 5/1987 | Yui et al. | |
| 4,915,428 | A * | 4/1990 | Hayakawa | 292/29 |
| 5,520,423 | A | 5/1996 | Finkelstein et al. | |
| 5,573,287 | A * | 11/1996 | Takimoto | 292/29 |
| 5,979,971 | A * | 11/1999 | Mizuki et al. | 296/155 |
| 6,134,837 | A | 10/2000 | Kawanobe et al. | |
| 6,412,222 | B1 * | 7/2002 | Hashiba et al. | 49/168 |
| 6,651,387 | B2 * | 11/2003 | Choi | 49/280 |
| 6,942,258 | B2 * | 9/2005 | Roos | 292/201 |
| 2001/0030430 | A1 * | 10/2001 | Roos | 292/216 |
| 2005/0236847 | A1 * | 10/2005 | Taniyama | 292/216 |

FOREIGN PATENT DOCUMENTS

| | | |
|---|---|---|
| DE | 1190835 B | 4/1965 |
| DE | 2 347 702 A1 | 3/1974 |
| GB | 2 210 339 A | 6/1989 |

OTHER PUBLICATIONS

German Search Report dated Feb. 6, 2006.

* cited by examiner

*Primary Examiner*—Peter M. Cuomo
*Assistant Examiner*—Mark Williams
(74) *Attorney, Agent, or Firm*—David S. Safran; Roberts Mlotkowski Safran & Cole, P.C.

(57) ABSTRACT

A sliding door for a motor vehicle which is movable in a sliding motion into an opened and a closed position is provided with a main lock arrangement by which the sliding door can be fixed in the closed position, and an auxiliary lock arrangement which supplements the holding force of the main lock arrangement when the sliding door is in the closed position. In an improvement over conventional sliding door arrangements of this type, the auxiliary lock arrangement is used not only for supplementing the main lock arrangement when fixing the sliding door in the closed position, but also for fixing the door in the opened position.

21 Claims, 5 Drawing Sheets

SLIDING DOOR FOR A MOTOR VEHICLE

BACKGROUND OF THE INVENTION

1. Field of the Invention

This invention relates to a sliding door for a motor vehicle, the sliding door being movable by a sliding motion into an opened and a closed position, a main lock arrangement being provided by which the sliding door can be fixed in the closed position, and an additional lock arrangement being provided to support the main lock arrangement when the sliding door is being fixed in the closed position. The invention also relates to a lock arrangement for such a sliding door.

2. Description of Related Art

Here, the term "sliding door" combines all components which are necessary for the functionality of a sliding door. They include, in addition to the movable component, also the corresponding frame which is provided in the motor vehicle body, guide rails which may be present, etc. Hereinafter, the concept "sliding door", wherever it is used for simple readability, is also used synonymously with the concept "movable component."

Sliding doors have been used for a long time for delivery trucks and vans and recently also for passenger vehicles. It is common to all sliding doors that they can be moved by a sliding motion into an opened and a closed position. This sliding motion takes place essentially parallel to the side wall of the motor vehicle. The fact that it is possible to load and unload and to get in and out without difficulty is especially advantageous.

Numerous versions are known for design implementation of the movement kinematics of a sliding door. They include, for example, the principle of rail guidance to which optionally a lever arrangement is added. Here, the special construction of the movement kinematics is not important. Rather, the approach in accordance to the invention can be applied to all conceivable constructions. Nor is it important where the sliding door on the motor vehicle is located, so that sliding doors located both laterally and also on the back on the motor vehicle are encompassed.

In particular, when using sliding doors for passenger cars, the guarantee of reliable fixing of the sliding door in the closed position acquires increasing importance. Unintentional opening of the sliding door, for example, by a force which acts from the inside perpendicularly on the sliding door, leads to considerable danger for the motor vehicle passengers.

At the same time, demands for convenience of use are steadily increasing. This includes, for example, the function of fixing the sliding door in the opened position so that the sliding door does not close independently when loading and unloading and when getting in and out. This function is necessary mainly when the motor vehicle is on a slope such that the weight of the sliding door presses in the closing direction.

The known sliding door underlying the present invention (U.S. Pat. No. 4,662,109) shows one approach to ensuring the secure fixing of the sliding door. In this case, a rail-guided sliding door is used which has a main lock arrangement on the side of the sliding door which is at the rear viewed in the direction of travel and an auxiliary lock arrangement on the side of the sliding door which is the front viewed in the direction of travel. The auxiliary lock arrangement supports the main lock arrangement when the sliding door is fixed in the closed position. This is advantageous especially when a force is acting perpendicularly on the sliding door from the inside toward the outside, since this force is accommodated via three points of force application, specifically the main lock arrangement, the rail guide and the auxiliary lock arrangement. Furthermore, the auxiliary lock arrangement opposes the movement of the sliding door in the opening direction, therefore essentially along the direction of travel. In one embodiment, the main lock arrangement has, as the latching elements, a conventional latch and ratchet, while the auxiliary lock arrangement is implemented by a simple hook. In normal operation, the main lock arrangement accommodates the largest part of the holding force necessary for fixing the sliding door in the closed position. The disadvantage in this known sliding door is the fact that the ease of use is comparatively poor. This is due, among other reasons, to the fact that there is no fixing of the sliding door in the opened position.

Another known sliding door (German Patent Application DE 2 347 702 A1) has, in addition to the main lock arrangement, a fixing arrangement by which the sliding door can be fixed in the opened position. The fixing arrangement is provided with a pivotable journal which is located on the movable component of the sliding door and engages a hook-shaped recess when the sliding door is moved into the opened position, thus preventing the sliding door from moving backward. The disadvantage in this sliding door with a fixing arrangement is the poor security against unintentional opening of the sliding door out of the closed position.

The same applies to the known sliding door of UK Patent Application GB 2 210 339 A which has a main lock arrangement for fixing the sliding door in the closed position and a fixing arrangement for fixing the sliding door in the opened position. Here, the security of fixing of the sliding door in the closed position against unintentional opening is small. In one embodiment, the main lock arrangement, at the same time, assumes the function of a fixing arrangement, by which the construction effort is reduced. This does not lead to an optimum solution with respect to the construction of the components involved, since the holding forces when the sliding door is in the opened position are much smaller than when the sliding door is in the closed position.

A corresponding combination of the aforementioned two functions, specifically the fixing of the sliding door in the closed position and the fixing of the sliding door in the opened position, is also shown by another known sliding door (U.S. Pat. No. 5,520,423) which has a system of two latches. The two latches are each assigned to the two aforementioned functions. Here, in any case, the problem of optimum construction also arises.

SUMMARY OF THE INVENTION

A primary object of this invention is to embody and develop the known sliding door for a motor vehicle such that secure fixing of the sliding door in the closed position is ensured with minimum construction effort and with maximum ease of use.

This object is achieved by a sliding door for a motor vehicle of the initially mentioned type by the auxiliary lock arrangement being made such that the sliding door can be fixed by the auxiliary lock arrangement in the opened position in addition to supplementing the holding force of the main lock arrangement in the closed position of the door.

What is important is the consideration that the auxiliary lock arrangement is used not only for supporting the main lock arrangement when fixing the sliding door in the closed position, but that the sliding door can also be fixed in the opened position by the auxiliary lock arrangement. Thus, on the one hand, reliable fixing of the sliding door in the closed position is ensured, and on the other hand, fixing of the sliding door in the opened position is ensured with minimum construction complexity.

It is especially advantageous that the auxiliary lock arrangement for both fixing the sliding door in the closed position and also fixing the sliding door in the opened position need not be designed to be especially strong as compared to the main lock arrangement. In this way, the sliding door can be designed in an optimum manner such that over-dimensioning is largely avoided. This generally leads to a reduction of production costs.

In accordance with one preferred configuration, the latch has a first recess for engaging a first engagement element and a second recess for engaging a second engagement element, the two recesses are formed between a pair of arms of a fork-shaped part of the latch, preferably opening and extending in opposite directions. This construction leads to an especially simple, and at the same time, compact design.

In another preferred configuration, the latch has a shoulder for engagement with the ratchet, the shoulder preferably being located on an arm of the fork-shaped part containing one of the two recesses. This feature ensures an especially simple construction since the ratchet merely engages a single shoulder—catch—of the latch. The catch position of the latch is identical when the sliding door is in the opened position and when the sliding door is in the closed position.

A further increase of the ease of use can be achieved by the configuration the ratchet of the engagement module can be raised in a motorized manner by a drive that has a drive motor and an actuating element and wherein the actuating element for motorized lifting of the ratchet can be caused to engage the ratchet.

It is noted that the lock arrangement for a sliding door of a motor vehicle of the invention has independent importance also outside of the particular environment of a sliding door of a motor vehicle.

Other details, features and advantages of this invention are explained in detail below with reference to the exemplary embodiments shown in the drawings.

DETAILED DESCRIPTION OF THE INVENTION

Figure 1:
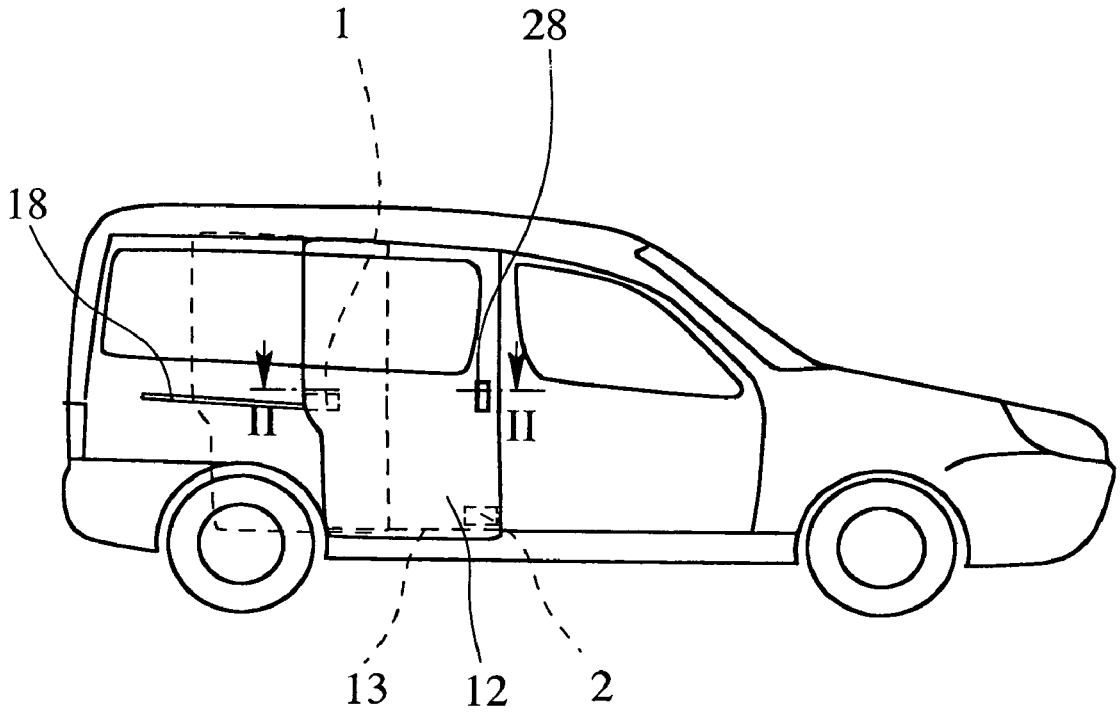
FIG. 1 is a schematic side view a motor vehicle with the sliding door in accordance with the invention.

FIG. 1 shows a motor vehicle equipped with the sliding door that can be moved in a sliding motion into opened and closed positions for opening and closing a loading and unloading opening of the motor vehicle. For this purpose, the sliding door is rail-guided, as is explained below. However, other designs can also be selected to implement the desired movement kinematics of the sliding door.

The sliding door is equipped with a main lock arrangement 1 by which the sliding door can be fixed in the closed position. To support the main lock arrangement 1 in the fixing of the sliding door in the closed position, there is an auxiliary lock arrangement 2. It is important that the auxiliary lock arrangement 2 is also made such that the sliding door can be fixed by the auxiliary lock arrangement 2 in the opened position (FIG. 2).

Figure 2:
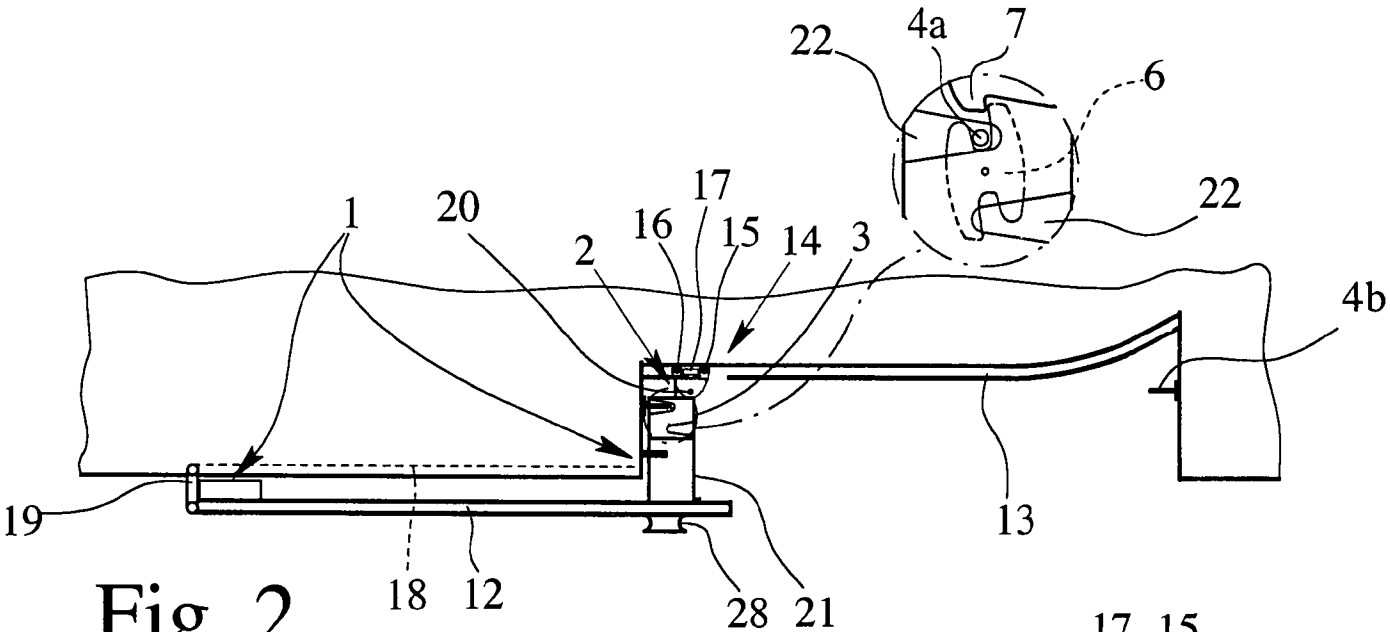
FIG. 2 is a sectional view of the sliding door taken along line II-II in FIG. 1 with the door in the opened position.
Figure 3:
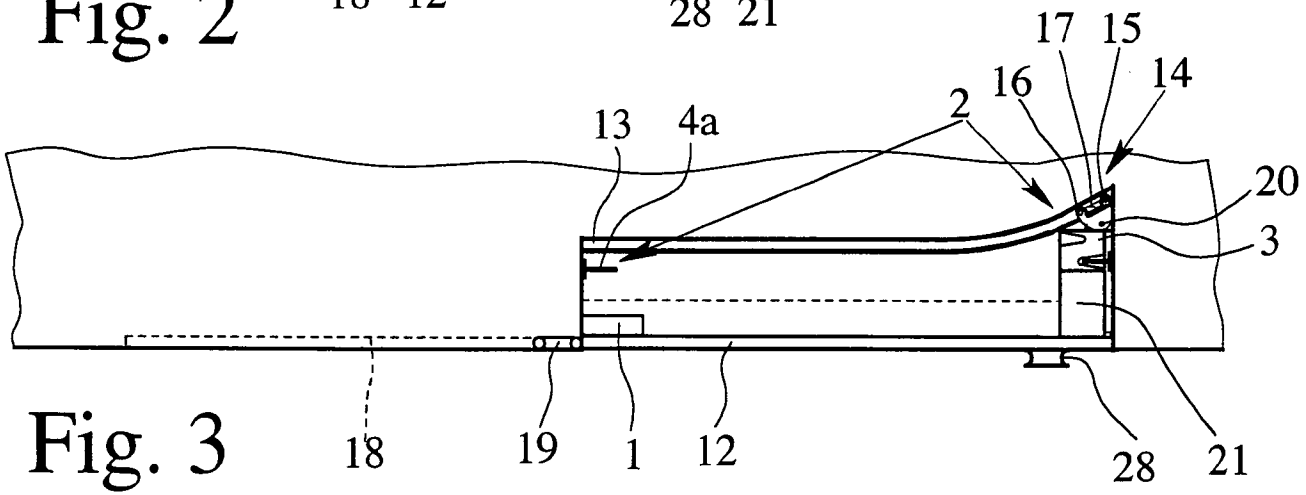
FIG. 3 is a sectional view of the sliding door taken along line II-II in FIG. 1 with the door in the closed position.

The main lock arrangement 1 is shown only schematically in FIGS. 1 to 3. The main lock arrangement 1 preferably has conventional latching elements, such as a latch and ratchet which interact in the conventional manner with a striker or the like. However, to implement the main lock arrangement 1, numerous other versions are possible. The specific configuration of the main lock arrangement 1 is not critical to this invention.

In a preferred configuration, the auxiliary lock arrangement 2 is made such that, when the sliding door is in the closed position, it can accommodate forces imposed perpendicular to the direction of travel. This means, first of all, the forces acting perpendicularly to the sliding door from the inside toward the outside. This configuration is especially advantageous for those cases in which articles or even passengers fall against the door while driving. The auxiliary lock arrangement 2 then opposes the unintentional opening of the sliding door.

The distribution of holding forces is optimum in that, when the sliding door is in the closed position, the main lock arrangement 1 and the auxiliary lock arrangement 2, viewed in the direction of travel, are located on opposite sides of the sliding door.

Different versions are possible for the respective height at which the main lock arrangement 1 and the auxiliary lock arrangement 2 are located on the sliding door. It is especially advantageous and less disruptive to the user, according to a preferred embodiment, if the main lock arrangement 1, viewed in the vertical direction, is located in the middle area of the sliding door, while the auxiliary lock, arrangement 2, viewed in the vertical direction, is located in the lower area or in the upper area of the sliding door. However, basically, both the main lock arrangement 1 and also the auxiliary lock arrangement 2 can be located in the middle area of the sliding door, viewed in the vertical direction.

It can be seen from FIGS. 2 & 3 that the auxiliary lock arrangement 2 has an engagement module 3 (also shown separately in the broken out, encircled detail of FIG. 2), a first engagement element 4*a* and a second engagement element 4*b*, the engagement module 3 when the sliding door 1 is moved into the opened position engaging the first engagement element 4*a* and in this way fixing the sliding door 1 in the opened position (FIG. 2). When the sliding door 1 is moved into the closed position the engagement module 3 then engages the second engagement element 4*b*, by which the sliding door 1 is fixed in the closed position. This should be understood in the aforementioned sense such that the auxiliary lock arrangement 2 supports the main lock arrangement 1 when the sliding door is fixed in the closed position.

It is noted that, basically, with the corresponding arrangement and configuration of the main lock arrangement 1 and auxiliary lock arrangement 2, the first engagement element 4*a* of the auxiliary lock arrangement 2, at the same time, can assume the function of the striker of the main lock arrangement 1.

Figure 4:
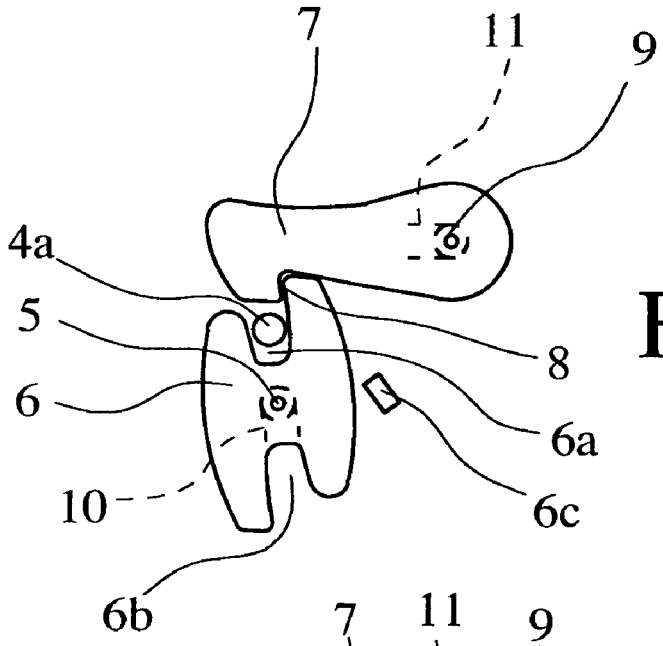
FIG. 4 schematically shows the position of the latch and the ratchet of the auxiliary lock arrangement when the sliding door in the opened position.
Figure 5:
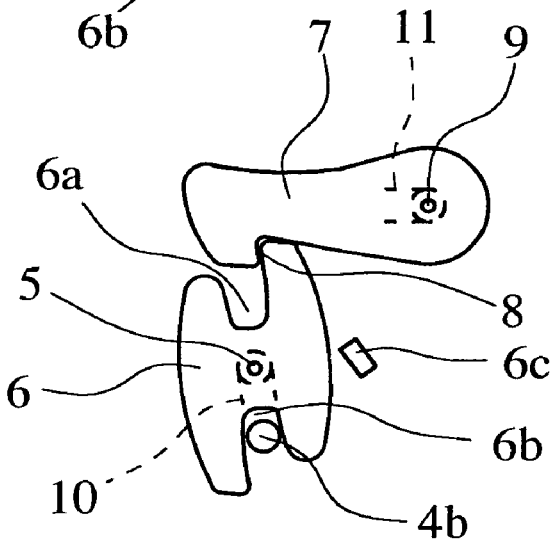
FIG. 5 schematically shows the position of the latch and the ratchet of the auxiliary lock arrangement when the sliding door in the closed position.
Figure 6:
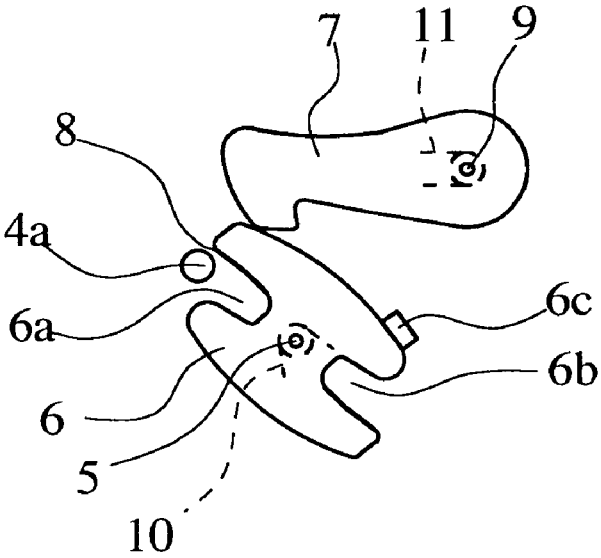
FIG. 6 schematically shows the position of the latch and the ratchet of the auxiliary lock arrangement when the sliding door is in an intermediate position.

The representation as shown in FIG. 2 and the representations as shown in FIGS. 4 to 6 show one especially preferred configuration of the engagement module 3 of the auxiliary lock arrangement 2. Here, the engagement module 3 for engaging the first engagement element 4*a* and, the second engagement element 4*b* has a latch 6 which can be pivoted around a pivot axis 5 and a ratchet 7 which is assigned to the latch 6. The latch 6 can be moved between the open position (FIG. 6) and the catch position (FIGS. 4 & 5) and is held in the catch position by the ratchet 7.

The latch 6 enables engagement with the first engagement element 4*a*, on the one hand, and the second engagement element 4*b* on the other. In a preferred configuration, the latch 6 is fork-shaped on one side having first recess 6*a* for engaging the first engagement element 4*a* and is fork-shaped on an opposite side having a second recess 6*b* for engaging the second engagement element 4*b*. In the illustrated preferred embodiment, the first and second recesses open and run in opposite directions. In doing so, the pivot axis 5 of the latch 6 is located preferably between the recesses 6*a*, 6*b* of the fork-shaped parts of the latch 6 so that the latch 6 is essentially H-shaped, as can be seen in FIGS. 4 to 6. Furthermore, these figures show that the fork-shaped parts which form the recesses 6*a*, 6*b*, each have two fork arms of different length. The special advantage of this configuration becomes clear from the following explanation of the manner of operation of the engagement module 3.

When the sliding door is moved into the opened position, in FIG. 3 to the left, the first engagement element 4*a* engages the first recess 6*a* (FIG. 6) and presses the latch into the catch position shown in FIG. 4. When the sliding door is moved into the closed position conversely the second engagement element 4*b* engages the second recess 6*b* and presses the latch 6 in turn into the catch position. For this purpose, the latch 6 likewise pivots around to the right so that pivoting of the latch 6 takes place in the same pivot direction when the sliding door is moved into the opened position and into the closed position.

In the preferred exemplary embodiment shown in FIGS. 4 to 6, when the sliding door is moved into the opened position or into the closed position and upon engagement with the engagement module 3, the two engagement elements 4*a*, 4*b*, viewed relative to the engagement module 3, are each located on "imaginary" paths of motion which lead past the pivot axis 5 of the latch 6. As shown in FIG. 4, the path of motion of the first engagement element 4*a* relative to module 3 passes above the pivot axis 5 of the latch 6. As shown in FIG. 5, the path of motion of the second engagement element 4*b* relative to module 3 passes underneath the pivot axis 5 of the latch 6. This does not mean that the two engagement elements 4*a*, 4*b* in fact run past the pivot axis 5. It should simply become apparent that the two engagement elements 4*a*, 4*b* are arranged offset to one another to ensure that they can engage the respectively assigned recess 6*a*, 6*b* as the engagement module 3 moves relative to them between the positions shown in FIGS. 2 & 3.

With the explanation above, it also becomes clear from FIG. 6 why the left arm of the fork-shaped part that forms the first recess 6*a* or the right arm of the fork-shaped part that forms the second recess 6*b* should be made shorter than the respectively opposing fork arm. This specifically ensures that the two engagement elements 4*a*, 4*b* engage the respectively assigned longer fork arm, and thus, press the latch 6 into the catch position. Furthermore, it is necessary for this purpose that the latch 6 be located diagonally in the open position with respect to the above described imaginary paths of motion, as is shown in FIG. 6.

With the aforementioned configuration of the latch 6, actuation of the latch 6 is completely symmetrical with respect to the two engagement elements 4*a*, 4*b*. In the simplest case, the latch 6 is made essentially point-symmetric with respect to its pivot axis 5. This can entail advantages especially with respect to production technology.

The locking of the latch 6 in the catch position is especially simple and compact for the preferred embodiment shown in FIGS. 4 to 6. For engagement with the ratchet 7, the latch 6 has a catch in the form of a shoulder 8, this shoulder 8 being located on the fork arm of one of the two recesses 6*a*, 6*b*. The ratchet 7 can engage and disengage the latch 6 by pivoting around its pivot axis 9. Here, it is such that the ratchet 7 can be caused to engage the longer fork arm of the first recess 6*a*. Depending on the application, here, there can also be two catches, for example, to implement a half-catch and a main catch, as is conventional in known side door locks.

Basically, several latches 6 can be provided located, preferably, parallel to one another in order to be able to accommodate large holding forces. In an especially preferred configuration, in any case, the latch 6 is the sole latch of the engagement module 3.

In the embodiment shown in FIGS. 2 & 3, the pivot axis 5 of the latch 6 is aligned essentially vertically. However, it can also be advantageous to align the pivot axis 5 of the latch 6 essentially horizontally.

Numerous versions are conceivable for the configuration of the engagement elements 4*a*, 4*b*. The engagement elements 4*a*, 4*b* can be made, for example, as shackles, cotter pins or the like.

The above described latch 6 with two recesses 6*a*, 6*b*, constitutes an especially simple design possibility for implementing the above described double function of the auxiliary lock arrangement 2. It is especially advantageous that the sequence of movements of the latch 6 and of the ratchet 7 is identical when the sliding door is being opened and closed.

The latch 6 is preferably pretensioned into its open position against a stop 6*c*. The ratchet 7 is also preferably pretensioned. For the embodiment shown in FIGS. 4 to 6, there is pretensioning of the ratchet 7 into the engagement position. For the respective pretensioning, the springs 10, 11 are assigned, respectively, to the latch 6 and the ratchet 7.

It has already been pointed out that any structural implementation of the movement kinematics of the sliding door, especially of the movable component 12 of the sliding door, can be used here. In the illustrated, preferred exemplary embodiment, the sliding door is guided in an inner guide rail 13, and for this purpose, has a roller arrangement 14. The roller arrangement 14 has two rollers 15, 16 for lateral guidance and another roller 17 for accommodating the weight of the movable component 12 of the sliding door. The guide rail 13 is located in the lower area of the loading and unloading opening.

In order to achieve a stable arrangement, according to one advantageous configuration, a like guide rail 13 can be provided in the upper area of the loading and unloading opening. Preferably, the outer guide rail 18 is located on the outside of the vehicle body which provides for stability especially when the sliding door is being moved into the opened position. The coupling between the movable component 12 of the sliding door and the outer guide rail 18 takes place preferably via a pivot element 19.

The inner guide rail 13 has a section which is bent toward the vehicle interior and which enables "countersinking" of the movable component 12 of the sliding door such that the closed sliding door on a first side closes flush with the vehicle body. On the other side, the pivot element 19 provides for the desired flush closure by pivoting in accordingly when the sliding door is moved into the closed position. When pivoted in, the main lock arrangement 1 is activated accordingly so that it ensures fixing of the sliding door in the closed position. Due to the above described bent configuration of the inner guide rail 13, the roller arrangement 14 must be coupled to the movable component 12 of the sliding-door to be able to pivot around a pivot axis 20. This becomes apparent from looking at FIGS. 2 & 3 together.

The engagement module 3 and the roller arrangement 14 are located together on a carrier component 21, the movable component 12 of the sliding door being attached to the carrier component 21. The engagement module 3 has two inlet slots 22 for the two engagement elements 4*a*, 4*b*.

A series of possibilities exist for lifting the ratchet 7 of the auxiliary lock arrangement 2, and thus, releasing the sliding door. In the exemplary embodiment shown in FIG. 7, the ratchet 7 of the engagement module 3 can be raised via a Bowden cable 23, and for this purpose, is coupled to the core 24 of the Bowden cable 23. This enables a space-saving and flexible arrangement of the engagement module 3.

Figure 7:
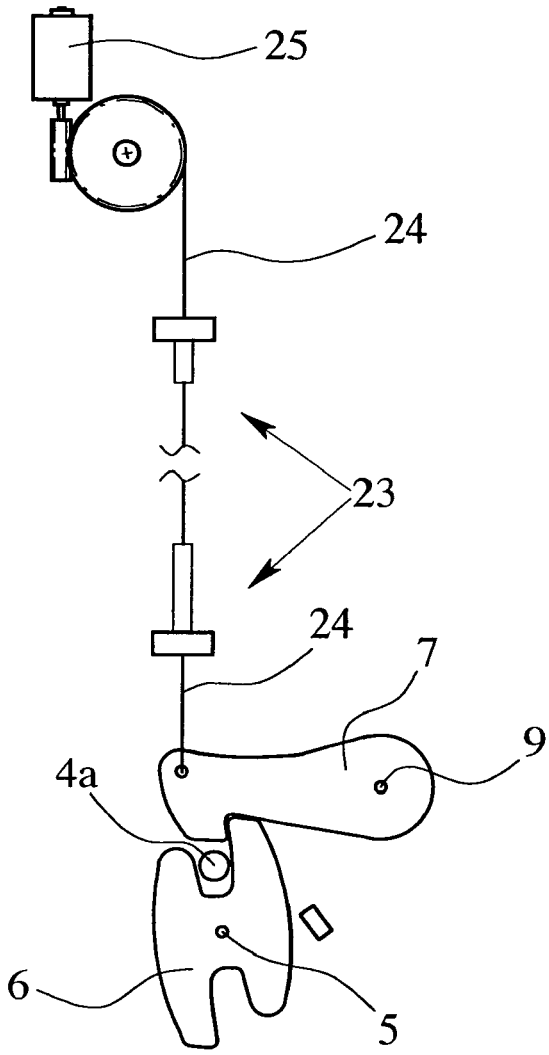
FIG. 7 shows the auxiliary lock arrangement with a drive for motorized lifting of the ratchet of the auxiliary lock arrangement when the sliding door in the opened position.

Furthermore, the auxiliary lock arrangement 2 can be actuated by a motor, and for this purpose, the ratchet 7 of the engagement module 3 can be raised in a motorized manner by a drive having a drive motor 25. The drive can, as shown in FIG. 7, engage the ratchet 7 via the Bowden cable 23.

Figure 8:
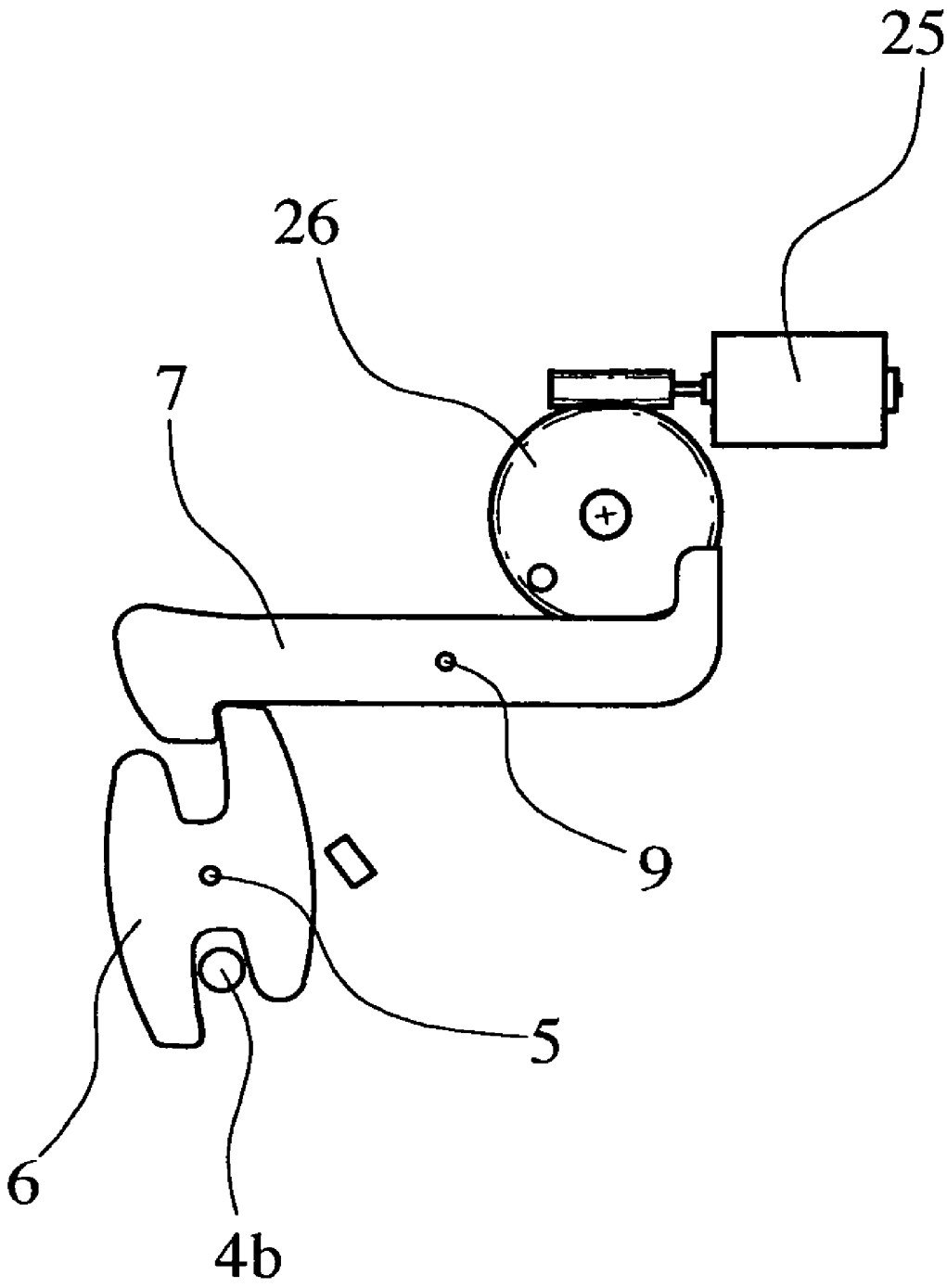
FIG. 8 shows an auxiliary lock arrangement with a drive for motorized lifting of the ratchet of the auxiliary lock arrangement when the sliding door in the opened position according to a second embodiment.

However, it can also be provided that the drive have an actuating element 26 addition to the drive motor 25 and that the actuating element 26 engage the ratchet 7 for motorized lifting of the ratchet 7. This is shown schematically in FIG. 8.

Figure 9:
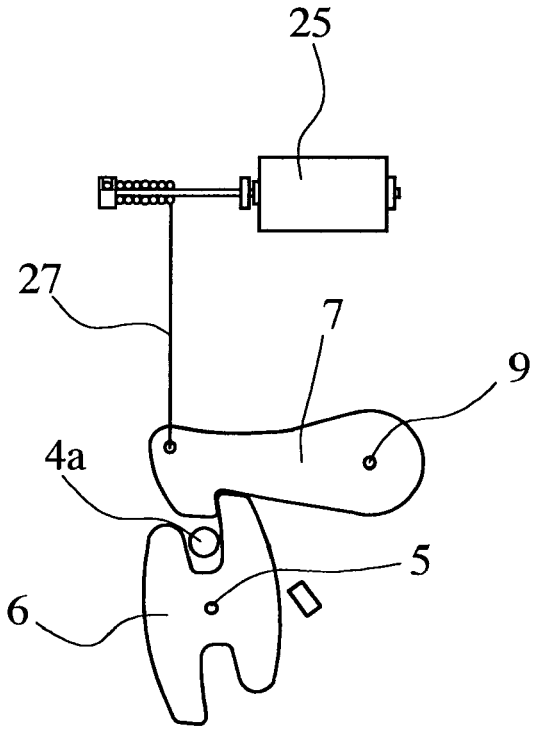
FIG. 9 shows an auxiliary lock arrangement with a drive for motorized lifting of the ratchet of the auxiliary lock arrangement when the sliding door in the opened position according to a third embodiment.

In another preferred configuration which enables, among other things, an especially quiet operation, it is provided that the drive has a drive motor 25 which is coupled to the ratchet 7 for motorized lifting of the ratchet 7 via a flexible pulling means 27, preferably via a cable pull. In the preferred exemplary embodiment shown in FIG. 9, the cable pull 27 is wound directly onto the drive shaft of the drive motor 25.

Finally, it should be pointed out again that the main lock arrangement 1 is preferably equipped with a lock mechanism which is not shown for implementation of various operating states. These operating states are for example those known for side door locks, that is, the center lock function CL, the double lock function DL or the child safety function CS. The auxiliary lock arrangement 2 is then preferably connected to the lock mechanism of the main lock arrangement 1. Thus the main lock arrangement 1 to a certain extent contains the "intelligence" of the sliding door, while the auxiliary lock arrangement 2 has simply the above described latching elements.

Basically the main lock arrangement 1, as described above in conjunction with the auxiliary lock arrangement 2, can also be made to be actuated by a motor. It is also conceivable for only a single drive to be provided for motorized actuation both of the main lock arrangement 1 and also the auxiliary lock arrangement 2. The two lock arrangements 1, 2 can be connected to one another by drive engineering, for example, via a Bowden cable.

In all versions, when the sliding door is being opened out of the closed position, first the auxiliary lock arrangement 2 and then the main lock arrangement 1 open. The reason for this sequence is that jamming of the auxiliary lock arrangement 2 is to be avoided. This tendency to jamming is due to the auxiliary lock arrangement 2 generally not being designed to accommodate all the holding force of the sliding door located in the closed position, so that when the main lock arrangement 1 is opened prematurely, slight deformation of the auxiliary lock arrangement 2, and thus, jamming can occur.

Preferably, an outside door handle 28 and an inside door handle (not shown) are intended actuation of the sliding door. However, exclusively electrical actuation, for example, via a remote control or the like, is also possible.

Finally, it is pointed out again that according to a lock arrangement 2, in terms of basic structure, corresponding to the auxiliary lock arrangement 2 with the latch 6 as shown in FIGS. 4 to 9, has independent importance. Depending on the design, this lock arrangement 2 can also be used in the sense of an auxiliary lock arrangement 2 to support the main lock arrangement 1. However, the lock arrangement 2 can also be designed such that it is equivalent to the main lock arrangement 1 of the sliding door with respect to the holding forces to be accommodated. Finally, the lock arrangement 2 can also be used as the sole lock arrangement 2 of a sliding door in certain applications.

What is claimed is:

1. Sliding door arrangement for a motor vehicle, comprising:

a sliding door which is movable in a sliding motion between an opened position uncovering an opening in a vehicle body and a closed position closing said opening in the vehicle body, inner and outer surfaces of the door extending across and covering said opening in said closed position;

a main lock arrangement for temporarily fixing the sliding door in the closed position, an auxiliary lock arrangement comprising a latch having a first latch element for supplementing the main lock arrangement when the sliding door is in the closed position, said auxiliary lock arrangement also having a second latch element for fixing the sliding door in the opened position;

wherein the first latch element of the auxiliary lock arrangement comprises a recess for engaging an engagement element on the vehicle body in the closed position, said recess having an interior surface facing in a direction substantially perpendicular to said inner and outer surfaces of the door of the door, said interior surface acting to resist any forces imposed on the door perpendicularly to the direction of said sliding motion and in a direction from said inner surface of the door toward said outer surface of the door when the sliding door is in the closed position by engagement of said interior surface of the recess against said engagement element.

2. Sliding door as claimed in claim 1, wherein the main lock arrangement and the auxiliary lock arrangement are located on opposite sides of the sliding door, viewed in the direction of travel, when the sliding door is in the closed position.

3. Sliding door as claimed in claim 1, wherein the main lock arrangement, viewed in a vertical direction, is located in a middle area of the sliding door, and the auxiliary lock arrangement, viewed in the vertical direction, is located in at least one of lower and upper areas of the sliding door.

4. Sliding door as claimed in claim 1, wherein the auxiliary lock arrangement comprises an engagement module having said latch elements, and a second engagement element being provided in addition to the engagement element that engages said recess in the closed position, the second engagement element engaging the second latch element of the engagement module when the sliding door is moved into the opened position for fixing the sliding door in the opened position.

5. Sliding door as claimed in claim 4, wherein the latch is pivotable around a pivot axis and thereby moveable between an open position and a catch position, and wherein a ratchet is assigned to the latch for holding the latch in the catch position and wherein said pivot axis extends parallel to said inner and outer surfaces of the door such that said latch pivots in a plane perpendicular to the inner and outer surfaces of the door.

6. Sliding door as claimed in claim 5, wherein the second latch element is a second recess and wherein the recess for engaging the first engagement element and the second recess for engaging the second engagement element open in opposite directions.

7. Sliding door as claimed in claim 6, wherein the pivot axis of the latch is located between the two recesses and wherein each of the recesses is formed between two fork arms of different length.

8. Sliding door as claimed in claim 7, wherein the latch has a shoulder for engagement with the ratchet, the shoulder being located on one of the arms of one of the two recesses.

9. Sliding door as claimed in claim 6, wherein the second engagement element engages the second recess and presses the latch into the catch position when the sliding door is moved into the opened position, and wherein the engagement element engages the recess and presses the latch into the catch position when the sliding door is moved into the closed position.

10. Sliding door as claimed in claim 5, wherein the two engagement elements, viewed relative to the engagement module, are each located on paths of motion which lead past the pivot axis of the latch when the sliding door is moved into either of the opened position and the closed position into engagement with the engagement module.

11. Sliding door as claimed in claim 5, wherein the latch is essentially point-symmetric with respect to its pivot axis.

12. Sliding door as claimed in claim 5, wherein the latch is the sole latch of the engagement module.

13. Sliding door as claimed in claim 5, further comprising a Bowden cable for raising the ratchet of the engagement module, the ratchet being coupled to a core of the Bowden cable.

14. Sliding door as claimed in claim 5, further comprising a motorized drive for raising the ratchet of the engagement module.

15. Sliding door as claimed in claim 14, wherein the drive has a drive motor and an actuating element, and wherein the actuating element is engageable with the ratchet for motorized lifting of the ratchet.

16. Sliding door as claimed in claim 14, wherein the drive has a drive motor which is coupled to the ratchet via a flexible pulling means for motorized lifting of the ratchet.

17. Sliding door as claimed in claim 1, wherein the engagement elements are one of posts, shackles and cotter pins.

18. Sliding door as claimed in claim 1, wherein the sliding door further comprises a roller arrangement that is guided in a guide rail.

19. Sliding door as claimed in claim 1, wherein the main lock arrangement is equipped with a lock mechanism for implementation of various operating states and wherein the auxiliary lock arrangement is connected to the lock mechanism of the main lock arrangement.

20. Sliding door as claimed in claim 1, wherein the auxiliary lock arrangement is positioned and arranged relative to the main lock arrangement such that first the auxiliary lock arrangement and then the main lock arrangement open when the sliding door is opened out of the closed position.

21. Lock arrangement for the sliding door of a motor vehicle which is movable into an opened and into a closed position by a sliding motion, the lock arrangement comprising:

an engagement module, a first engagement element, and a second engagement element, wherein the engagement module engages the first engagement element, in an installed arrangement thereof in a vehicle, when the sliding door is moved into the opened position for latching the sliding door in the opened position, wherein the engagement module engages the second engagement element, in an installed arrangement thereof in a vehicle, when the sliding door is being moved into the closed position for latching the sliding door in the closed position, wherein the engagement module has a latch which is pivotable around a pivot axis between an open position and a catch position and which engages the first engagement element and the second engagement element in respective positions of the door, and a ratchet which engages the latch for holding it in the catch position, wherein the latch has a first fork-shaped part with fork arms of different length on opposite sides of a first recess for engaging the first engagement element and a second fork-shaped part with fork arms of different length on opposite sides of a second recess for engaging the second engagement element, wherein the first and second recesses open and extend in opposite directions such that the arms of the fork-shaped parts are positioned to create an essentially H-shaped form of the latch, wherein the pivot axis of the latch is located between the recesses of the fork-shaped parts and between the fork arms of different length of each of the first and second recesses, and wherein the engagement elements are engageable with a longer of the fork arms of different length for moving the latch into the catch position.

* * * * *